US008827590B2

(12) United States Patent
Sawyer et al.

(10) Patent No.: US 8,827,590 B2
(45) Date of Patent: Sep. 9, 2014

(54) STRUCTURAL UNDERLAYMENT SUPPORT SYSTEM AND PANEL FOR USE WITH PAVING AND FLOORING ELEMENTS

(71) Applicant: Brock USA, LLC, Boulder, CO (US)

(72) Inventors: Daniel C. Sawyer, Boulder, CO (US); Richard R. Runkles, Windsor, CO (US)

(73) Assignee: Brock USA, Boulder, CO (US)

( * ) Notice: Subject to any disclaimer, the term of this patent is extended or adjusted under 35 U.S.C. 154(b) by 0 days.

(21) Appl. No.: 14/246,171

(22) Filed: Apr. 7, 2014

(65) Prior Publication Data

US 2014/0219717 A1 Aug. 7, 2014

Related U.S. Application Data

(63) Continuation of application No. 14/196,780, filed on Mar. 4, 2014, which is a continuation of application No. 12/830,902, filed on Jul. 6, 2010, now Pat. No. 8,662,787, which is a continuation-in-part of application No. 12/009,835, filed on Jan. 22, 2008, now Pat. No. 8,236,392.

(60) Provisional application No. 61/223,180, filed on Jul. 6, 2009, provisional application No. 61/228,050, filed on Jul. 23, 2009, provisional application No. 61/239,206, filed on Sep. 2, 2009, provisional application No. 61/297,236, filed on Jan. 21, 2010, provisional application No. 60/881,293, filed on Jan. 19, 2007, provisional application No. 60/927,975, filed on May 7, 2007, provisional application No. 61/000,503, filed on Oct. 26, 2007, provisional application No. 61/003,731, filed on Nov. 20, 2007.

(51) Int. Cl.
*E01C 3/06* (2006.01)
*E01C 3/00* (2006.01)

(52) U.S. Cl.
CPC ..... *E01C 3/003* (2013.01); *E01C 3/006* (2013.01)
USPC ..... 404/28; 404/18; 404/27; 404/34

(58) Field of Classification Search
CPC ..... E01C 3/06
USPC ..... 404/17, 18, 27–29, 34–36
See application file for complete search history.

(56) References Cited

U.S. PATENT DOCUMENTS 2,746,365 A 5/1956 Dameille
3,626,702 A 12/1971 Monahan
(Continued)

FOREIGN PATENT DOCUMENTS

DE 9310473 U1 9/1993
DE 20119065 U1 5/2002
(Continued)

OTHER PUBLICATIONS

PCT International Search Report, Application No. PCT/US2010/041046, Date Jul. 6, 2010.
(Continued)

*Primary Examiner* — Raymond W Addie
(74) *Attorney, Agent, or Firm* — MacMillan, Sobanski & Todd, LLC

(57) ABSTRACT

A paving system for paving or flooring includes a top layer of a plurality of paving elements, and an underlayment support layer of a polymeric material configured into panels. The panels are suitable to support the paving elements, the panels having a generally planar support surface.

30 Claims, 11 Drawing Sheets

(56) References Cited

U.S. PATENT DOCUMENTS

| | | | | |
|---|---|---|---|---|
| 4,146,599 | A | 3/1979 | Lanzetta | |
| 4,445,802 | A | 5/1984 | Loov | |
| 5,073,061 | A | 12/1991 | Jones | |
| 5,102,260 | A | 4/1992 | Horvath et al. | |
| 5,342,141 | A | 8/1994 | Close | |
| 5,363,414 | A * | 11/1994 | Muto | 375/340 |
| 5,363,614 | A | 11/1994 | Faulkner | |
| 5,383,314 | A * | 1/1995 | Rothberg | 52/169.5 |
| 5,531,044 | A | 7/1996 | Wallenius | |
| 5,549,418 | A * | 8/1996 | Devine et al. | 405/258.1 |
| 5,640,801 | A | 6/1997 | Rynberk | |
| 5,957,619 | A * | 9/1999 | Kinoshita et al. | 404/31 |
| 6,033,146 | A | 3/2000 | Shaw et al. | |
| 6,551,016 | B2 | 4/2003 | Guidon | |
| 6,796,096 | B1 * | 9/2004 | Heath | 52/403.1 |
| 6,802,669 | B2 | 10/2004 | Ianniello et al. | |
| 6,818,274 | B1 | 11/2004 | Buck et al. | |
| 7,090,430 | B1 | 8/2006 | Fletcher | |
| 7,244,076 | B2 * | 7/2007 | Whitson | 404/73 |
| 7,344,334 | B2 * | 3/2008 | Thorkelson | 404/29 |
| 7,516,587 | B2 * | 4/2009 | Barlow | 52/591.2 |
| 7,901,603 | B1 * | 3/2011 | Beholz | 264/48 |
| 8,236,392 | B2 | 8/2012 | Sawyer et al. | |
| 8,662,787 | B2 | 3/2014 | Sawyer et al. | |
| 2001/0048849 | A1 | 12/2001 | Rinninger | |
| 2003/0020057 | A1 | 1/2003 | Sciandra | |
| 2003/0039511 | A1 | 2/2003 | Prevost | |
| 2003/0223826 | A1 | 12/2003 | Ianniello | |
| 2004/0058096 | A1 | 3/2004 | Prevost | |
| 2004/0069924 | A1 | 4/2004 | Lemieux et al. | |
| 2005/0028475 | A1 | 2/2005 | Barlow | |
| 2005/0042394 | A1 | 2/2005 | Sawyer et al. | |
| 2006/0032170 | A1 | 2/2006 | Vershum et al. | |

FOREIGN PATENT DOCUMENTS

| | | | |
|---|---|---|---|
| EP | 1243698 | A1 | 9/2002 |
| FR | 2762635 | A1 | 10/1998 |
| JP | 54032371 | U | 3/1979 |
| JP | 8049209 | A | 2/1996 |
| JP | 2008008039 | A | 1/2008 |
| NL | 1004405 | C1 | 2/1997 |
| WO | 02/09825 | A1 | 2/2002 |
| WO | 03/000994 | A1 | 1/2003 |
| WO | 2004/011724 | A1 | 2/2004 |
| WO | 2006116450 | A2 | 11/2006 |
| WO | 2007002442 | A1 | 1/2007 |

OTHER PUBLICATIONS

CPI Tek, Concrete Paver Institute, CPI Tek 2 Brochure, 1990, 4 pages.

CPI Tek, Concrete Paver Institute, CPI Tek 3 Brochure, 1993, 4 pages.

"Do-It-Yourself Paths and Patios", A Step by Step Guide to Installing Ultralock 9000 Interlocking Pavers, The Family Handyman, brochure by Bend Industries, 1992, 12 pages.

European Examination Report, Application No. EP 10 734 609.0 dated Apr. 9, 2013.

European Office Communication, Application No. EP 10 734 609.0-1601 dated Oct. 16, 2013.

European Search Report, 10195632.4, dated Apr. 12, 2012.

European Search Report, 10195633.2, dated Apr. 12, 2012.

PCT International Search Report, Application No. PCT/US20101041046, Date Jul. 6, 2010.

* cited by examiner

STRUCTURAL UNDERLAYMENT SUPPORT SYSTEM AND PANEL FOR USE WITH PAVING AND FLOORING ELEMENTS

CROSS-REFERENCE TO RELATED APPLICATIONS

This application is a Continuation of U.S. application Ser. No. 14/196,780, filed Mar. 4, 2014.

Application Ser. No. 14/196,780 is a Continuation of U.S. application Ser. No. 12/830,902, filed Jul. 6, 2010, issued Mar. 4, 2014 as U.S. Pat. No. 8,662,787.

U.S. Pat. No. 8,662,787 claims the benefit of U.S. Provisional Application No. 61/223,180, filed Jul. 6, 2009; U.S. Provisional Application No. 61/228,050, filed Jul. 23, 2009; U.S. Provisional Application No. 61/239,206, filed Sep. 2, 2009; and U.S. Provisional Application No. 61/297,236, filed Jan. 21, 2010.

U.S. Pat. No. 8,662,787 is a Continuation-In-Part of U.S. application Ser. No. 12/009,835, filed Jan. 22, 2008, now U.S. Pat. No. 8,236,392, issued Aug. 7, 2012.

U.S. Pat. No. 8,236,392 claims priority from U.S. Provisional Application 60/881,293, filed Jan. 19, 2007, U.S. Provisional Application 60/927,975, filed May 7, 2007, U.S. Provisional Application 61/000,503, filed Oct. 26, 2007, and U.S. Provisional Application 61/003,731, filed Nov. 20, 2007. The disclosures of these applications are incorporated herein by reference in their entirety.

BACKGROUND OF THE INVENTION

This invention relates in general to paver brick support systems. Discrete paving elements, such as bricks and stones, are used for outdoor patios and other similar structures. The pavers can provide a durable and aesthetically pleasing surface. The pavers are usually supported on a base layer to insure that the pavers provide a level surface when installed. These paved surfaces are susceptible to the environment and other forces that sometimes cause the supporting base of the pavers to shift or otherwise settle over time. When this happens, the paving elements may also shift, causing the surfaces to become uneven and difficult to traverse. Uneven surfaces can present difficulties for supporting objects in a stable condition.

It would be advantageous if there could be developed an improved structure and method for supporting and installing paving elements.

SUMMARY OF THE INVENTION

This invention relates to a paving system for paving or flooring, including a top layer of a plurality of paving elements, and an underlayment support layer of polymeric material in the form of panels, the panels being suitable to support the paving elements, the panels being made of a core with a top side and a bottom side. There are three possible configurations, wherein, (1) the top side has a plurality of spaced apart, upwardly oriented projections that define channels suitable for water flow along the top side of the core when the underlayment layer is positioned beneath the layer of paver elements, (2) the bottom side includes a plurality of spaced apart, downwardly oriented projections that define channels suitable for water flow when the underlayment layer is positioned beneath the layer of paver elements, or (3) both the top side and the bottom side include a plurality of projections defining channels suitable for water flow when the underlayment layer is positioned beneath the layer of paver elements.

According to this invention there is also provided a paving system for paving or flooring including a top layer of a plurality of paving elements, and an underlayment support layer of a polymeric material configured into panels, the panels being suitable to support the paving elements, the panels having a generally planar support surface and a recovery characteristic such that a deformation from a concentrated compressive load applied for a short duration returns the support surface to a generally planar condition.

According to this invention there is also provided a paving system for paving or flooring, the paving system including a top layer of a plurality of paving elements, and also including an underlayment support layer of a polymeric material configured into panels, the panels being suitable to support the paving elements, and the panels being porous to the flow of fluids.

According to this invention there is also provided a paving system comprising native soil, a layer of bedding sand, an underlayment support layer of a polymer material, and a layer of paving elements.

According to this invention there is also provided a method of installing a paving system, the method including excavating surface material and preparing a substantially level surface on native soil, applying a layer of bedding sand to the native soil, applying an underlayment support layer of polymer material to the bedding sand, and applying a layer of paving elements.

According to this invention there is also provided a paving system for paving or flooring, the paving system including a top layer of a plurality of paving elements, and an underlayment support layer of a polymeric material configured into panels, the panels being suitable to support the paving elements, and the panels being made of recyclable material.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
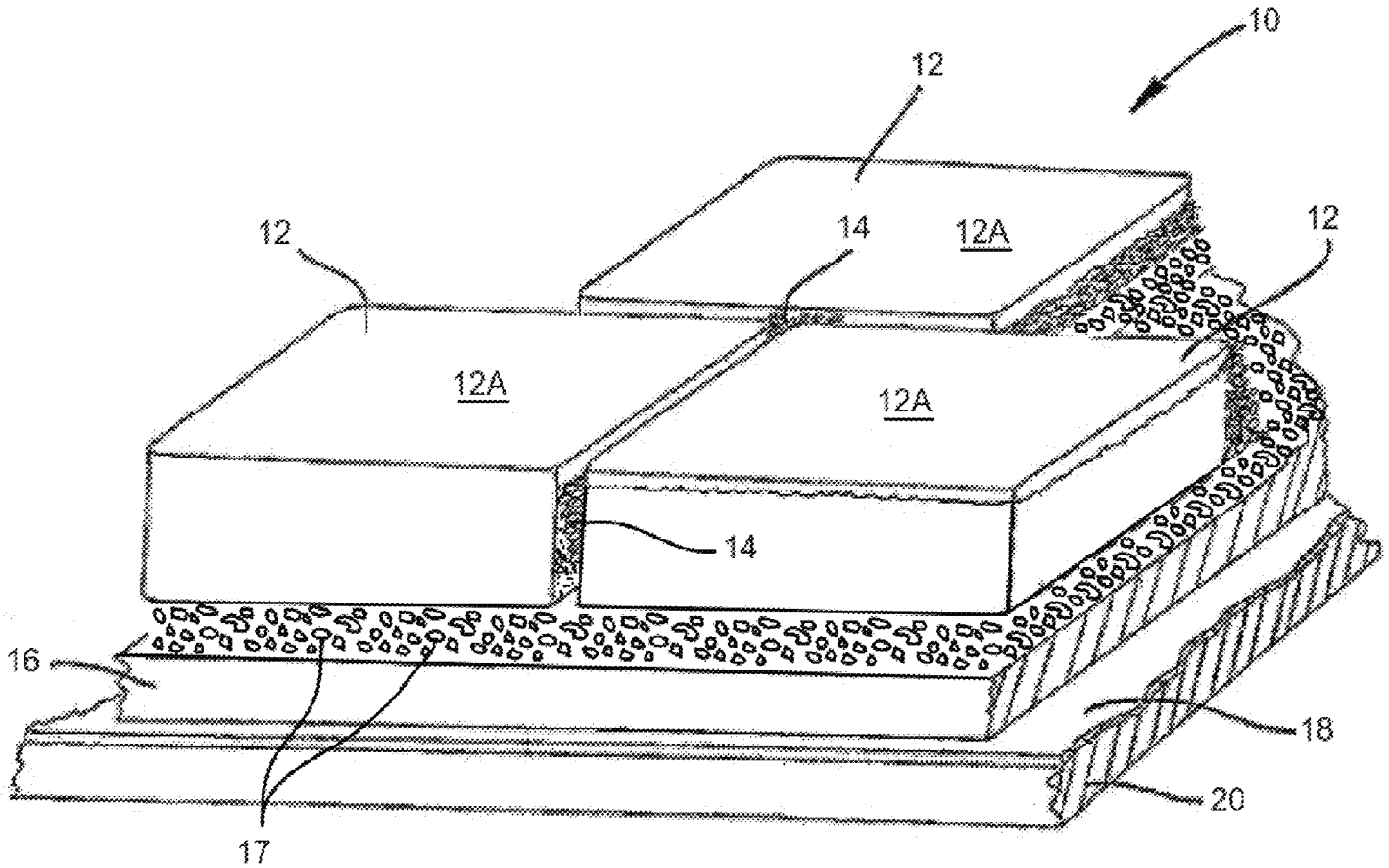
FIG. 1 is a perspective view of a paving system having an underlayment support layer.

Referring now to the drawings, there is illustrated in FIG. 1 a paving system, shown generally at 10. While described in the context of an exterior or outdoor structure, the paving system 10 may be applicable to interior systems as well, as will be explained below in detail. The paving system 10 includes a plurality of paving elements 12 having an exposed surface 12A that is suitable for activities requiring a supportive surface, such as pedestrian activities or vehicular activities. The paving system 10 may be, for example, a sidewalk, a patio, or a driveway. The paving elements 12 are illustrated as paving bricks, though other paving elements such as, for example, natural stones, flagstones, river rock, artificial stones, concrete tiles, and the like may be alternative equivalent elements. The paving elements 12 may be porous to the flow of water or other fluids, or may be impervious. The paving system 10 may alternatively be an interior support system where the paving elements 12 may alternatively be rubber or wooden blocks applied in an interior environment, such as is used in construction of factory floor systems.

As shown in FIG. 1 an optional joint sand treatment 14 is applied to the paving elements 12. The joint sand treatment 14 is composed of sand, which may be loose or compacted. Alternatively, the joint sand treatment can be any natural of artificial medium such as, for example, ground rubber, clay, dirt, silica particulate, crushed glass, and the like. A mixture of sand and polymer material can be used, where the mixture is formulated to set up or harden into a hard component of the paving system 10. Alternatively, the paving elements 12 may be arranged so that the sides, or portions thereof, are touching such that the joint sand treatment 14 is not disposed between adjacent elements 12.

The paving elements 12 are installed above an underlayment support layer 16, which is comprised of a foamed material. More specifically, the underlayment layer 16 shown in FIG. 1 is formed from a plurality of polymer beads 30 (shown in FIG. 7A) that are bonded together to form a unitary body or block. The polymer beads 30 may be formed from any material, but in various embodiments the beads are formed from polypropylene, polyethylene, or polystyrene, or mixtures of those materials. Methods of forming the foamed underlayment support layer 16 will be disclosed below. Also, as disclosed below, the underlayment support layer 16 can be made of non-foamed polymeric material. While the paving system 10 is described with the underlayment support layer 16 in the form of separate panels, it is to be understood that the underlayment support layer 16 can just as well be applied in the form of a roll of the material. Accordingly, the term "panel" includes the material in the form of continuous material that can be unrolled to form the underlayment support layer 16.

The thickness of the underlayment layer 16 can vary, depending on the particular configuration of the support system 10 for which the underlayment layer is to be used. In one embodiment the thickness is in the range of from about 0.25 inches (6 mm) to about 1.25 inches (32 mm). In another embodiment, the underlayment layer 16 is a thin sheet with a thickness within the range of from about 0.0625 inch (1.6 mm) to about 0.25 inch (6 mm), and in particular about 0.125 inch (6 mm). In yet another embodiment, the underlayment layer is thicker than 1.25 inches (32 mm).

The paving system 10 rests on the underlying ground, referred to as the substrate layer 20. The substrate layer 20 may be dirt, sand, clay, concrete, crushed stone, and the like. The substrate layer 20 may be undisturbed, native soil or may be compacted native soil or may be a graded and/or compacted aggregate base layer. In one embodiment, a layer of leveling material, such as a thin layer of bedding sand (not shown in FIG. 1), can be applied to the substrate layer 20 before the underlayment support layer 16 is added.

As shown in FIG. 1, a layer of bedding sand 17 is applied to the underlayment support layer 16. This layer is optional, but if applied it provides a smooth, relatively level bed or surface on which the paving elements 12 are laid. The bedding sand layer 17 can optionally act as a filter layer that can trap contaminants passing through the paving system 10. Such a filter layer may further include piping to transfer effluent, whether filtered or not, away from the support system 10. The bedding sand layer 17 may alternatively include a biological organism capable of breaking down pollutants into harmless matter that may be further filtered out prior to introduction of drainage water into the water table. The bedding sand 17 can be of any suitable particulate material, such as the material used for the joint sand 14.

Optionally, a soil barrier layer 18 can be applied between the underlayment layer 16 and the underlying soil or substrate 20. The soil barrier layer 18 may be a geo-textile material such as, for example, a woven or nonwoven fabric that is water permeable or a solid material that is water impervious. The purpose of the geo-textile material is to substantially preclude the mixing of the material above and below the geotextile layer. For example, the layer can substantially preclude the mixing of a layer of bedding sand above the geotextile material with the sub-soil layer beneath the geotextile layer. The desirability of having water flow through the various layers or having the water diverted to other locations may be partially dictated by the type and condition of the substrate layer 20.

Figure 7B:
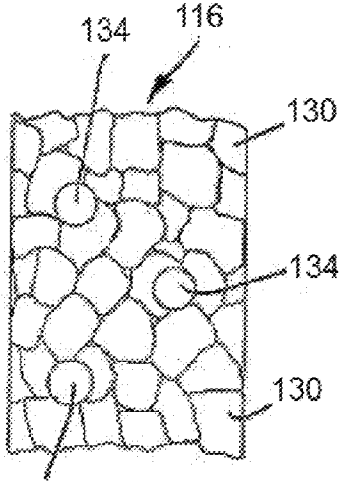
FIG. 7B is an enlarged elevational view of an alternative embodiment of an underlayment support layer having a fused bead structure and further having drainage holes formed therethrough.

As shown in FIG. 7B, the underlayment layer 116 of one embodiment is similar to the analogous layer 16 of FIG. 1. The underlayment support layer 116 is formed from beads 130, that are made of polymers such as polypropylene, polyethylene, and polystyrene, and the like. The fused beads 130 may alternatively be a mixture of polymer materials. The beads 130 are expanded to reduce their density. The beads 130 may be molded under heat and compression to bond the beads together, and to compress the beads to the extent sufficient to substantially remove the interstitial voids between the beads.

Prior to the molding process, the fused beads 130 can be initially formed together by localized melting and fusing of the adjacent surfaces, although other bonding systems can be used. The fused beads 130 may also require no adhesive mixture.

In one optional method of manufacture, the beads are originally manufactured as tiny solid plastic pellets, which are later processed in a controlled pressure chamber to expand them into larger foam beads having a diameter within the range of from about 2 millimeters to about 5 millimeters. The foam beads are then blown into a closed mold under pressure so they are tightly packed. Finally, steam is used to heat the mold surface so the beads soften and melt together at the interfaces, forming the underlayment support layer 116 as a solid material that is water impervious. Other methods of manufacture can be used, such as mixing the beads with an adhesive or glue material to form a slurry. The slurry is then molded to shape and the adhesive cured.

Referring now to FIGS. 9-12, there is illustrated an underlayment support layer 316 that can be used with various paving systems. The panel 316 is comprised of a core 340, a top side 342 and a bottom side 344. The top side 342 contains a plurality of spaced apart, upwardly oriented projections 350, and the bottom side 344 contains spaced apart downwardly oriented projections 370. It is to be understood that the projections need not be on both the top side and bottom side, but can be on one or the other in some embodiments. The projections 350 have truncated tops that form a plane that defines an upper support surface 352 configured to support the paving elements. The projections 350 do not necessarily require flat, truncated tops. The projections 350 may be of any desired cross sectional geometric shape, such as square, rectangular, triangular, circular, oval, or any other suitable polygon structure. The projections 350 may have tapered sides extending from the upper support surface 352, or may have vertical sides. The projections 350 may be positioned in any suitable arrangement, such as a staggered arrangement, and may be any height desired. In one embodiment the projections 350 are in the range of about 0.5 millimeters to about 6 millimeters. One of the advantages of the use of downwardly oriented projections is that they can prevent the panel from sliding laterally on the sand or subgrade layer below it, or at least substantially reduce such sliding.

The sides of adjacent projections 350 cooperate to define channels 356 that form a labyrinth across the panel 350 to provide lateral drainage of water that migrates down from the paver elements. The channels 356 are suitable for water flow along the top side of the panel 316 when the underlayment layer is positioned beneath a layer of paving elements. Even though the channels are often packed with particulate material, such as the bedding sand 17, the channels are still beneficial in providing a path for the flow of water draining through the paving system 10. The water can flow through the sand in the channels.

Optionally, the channels 356 have drain holes 358 spaced apart and extending through the thickness of the panel 316. Projections 370 can be likewise formed on the bottom side 344 of the panel 316, with the projections forming bottom channels 376. The channels 376 are suitable for water flow along the bottom of the panel 316. In one embodiment, the drain holes connect the top channels 356 for fluid communication with the bottom channels 376.

The size of the drainage holes 358, the frequency of the drainage holes 358, the size of the drainage channels 356 on the top side 342 or the channels 376 on the bottom side 344, and the frequency of the channels 356 and 376 provide a design where the channels 356, 376 can be aligned with each other to create a free flowing drainage system. The size and quantity of the top side channels 356, bottom side channels 376, and drain holes 358 can provide dispersion of fluid flow through the paving system sufficient to reduce soil erosion beneath the paving system.

Figure 11:
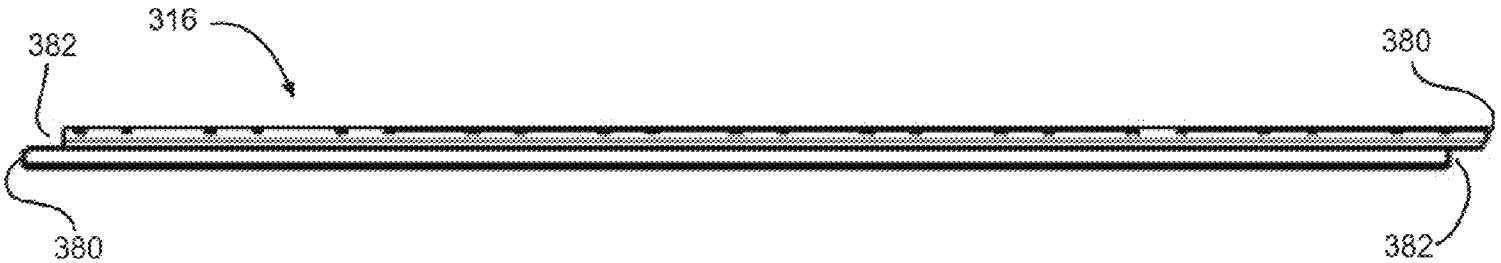
FIG. 11 is an elevational view of the panel of FIG. 9.
Figure 12:
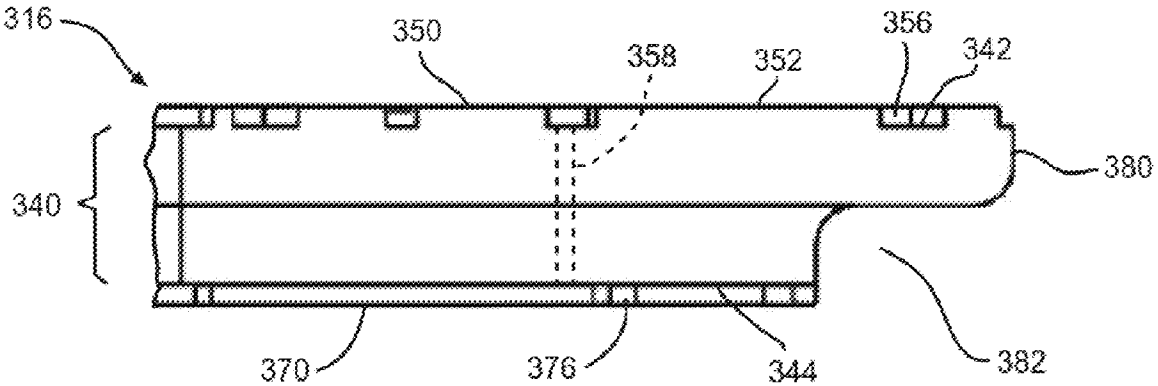
FIG. 12 is an enlarged view of an end portion of the panel shown in FIG. 11.

In a specific embodiment, the panels 316 are provided with a mechanism for interconnection with each other. One such mechanism is shown in FIGS. 11 and 12. The panel 316 includes on two of its edges an overlapping portion or flange 380 and a corresponding recessed portion 382. These features are configured to mate with each other in an overlapping manner on adjacent panels 316 to provide an interconnection with each other. Other connection mechanisms can be used.

The bottom side 370 projections can be the same size as the size of the top side projections 350, or may be a different size. A drainage system, not shown, can be connected to the channels 356 and 376 for the removal of fluids.

The deformation characteristics of the underlayment support layer panel 316 may be of particular interest for some applications. Advantageously, the panel 316 is soft enough that it allows the installer of the paving system 10 to comfortably kneel on the panel 316 in order to work on the installation of the pavers. This requires the panel 316 to be able to deform when under load to distribute the forces to the point that the kneeling installer is comfortable. In one embodiment, the panels, while being suitable to support the paving elements, have a generally planar support surface and a recovery characteristic such that a deformation from a concentrated compressive load applied for a short duration returns the support surface to a generally planar condition. In a specific embodiment, the deformation is at least 5 percent under the concentrated compression load. It is advantageous, however, if the deformation is not so great as to form a permanent indentation or deformation in the underlayment support layer panel 316. In a specific embodiment the deformation is less than or equal to 10 percent under the concentrated compression load.

Example I

An underlayment support layer was formed by placing expanded polypropylene beads into a mold under pressure and subjecting the confined beads to a steam application sufficient to soften and melt together the beads at interfaces between the beads. The panel had a thickness of 20.71 mm, and a density of 55 g/l. The panel was subjected to a load to simulate the load of a 235 pound paving system installer. The load selected was applied to the surface over an area of approximately 3.14 square inches, using a tool with a square impact surface 1.414 inches (3.59 cm) on a side. The impact surface is equivalent to a 2 inch diameter area, to represent the load applied by the worker kneeling on the underlayment support layer 16 on one knee, without knee pads. The load applied was 150 pounds (68.1 kg), which is equivalent to 75 psi (pounds per square inch) (517.5 kPa). The load was applied for 10 seconds, and then removed. The deformation of the panel was measured while the load was being applied, immediately after the load was removed, and at a time 2 hours after the load was removed. The results are shown in Table I as follows:

TABLE 1

| | |
|---|---|
| Deformation under load | 8.4 % |
| Deformation after 2 hours | 6 % |

The compression of the panel immediately after the load was removed was 1.74 mm, and the compression after 2 hours was 1.25 mm.

Example II

Other sample foams were subjected to the same loading procedure. The panels included a Styrofoam product from a Styrofoam cooler (having an initial thickness of 17.19 mm), a Styrofoam insulation sheet (having an initial thickness of 17.7 mm), and a sample of Arcel (having an initial thickness of 20.28 mm), which is a combination of Styrofoam and EPP (expanded polypropylene). The results of the testing are shown in Table II as follows:

TABLE II

| | | |
|---|---|---|
| Styrofoam cooler | deformation under load | 35.6% |
| Styrofoam cooler | 2 hour deformation | 33.5% |
| Styrofoam insulation | deformation under load | 24.2% |
| Styrofoam insulation | 2 hour deformation | 22.5% |
| Arcel sample | deformation under load | 29.5% |
| Arcel sample | 2 hour deformation | 25.5% |

In one embodiment of the paving system, the deformation is less than 7 percent two hours after removal of the compression load from the panel. In another embodiment of the invention the density of the panel is within the range of from about 40 to about 70 g/l. In a specific embodiment, the density of the panel is within the range of from about 50 to about 60 g/l.

Another way to assess the deformation characteristic of the underlayment support layer is to determine the amount of permanent compression imparted to the underlayment support layer when subjected to various compression loads during normal installation. Advantageously, the deformation from typical loads such as the kneeling installer or an installer walking on the underlayment support layer does not impart a permanent defect or deformity in the surface of the underlayment support layer. Depressions in the surface of the underlayment support layer of significant size will cause imperfections in the smoothness of the upper surface of the paving elements 12, or may allow undesirable movement of the paving elements. In one embodiment, the depression in the surface of the underlayment support layer is less than about 2.0 mm when subjected to a compression load of 75 psi 517.5 kPa) applied for 10 seconds over a 2 inch (5 cm) diameter area, when measured 2 hours after removal of the load.

The data above shows that the underlayment support layer panels 16 of Example I result in relatively minimal deformation to the upper surface of the panels during the types of loading normally encountered during installation. In contrast, the alternative materials when tested resulted in deformations that were significant in their magnitude, and would likely result in a defective installation. The surface imperfections would likely result in an unacceptably uneven upper surface for the paving elements 12. Also, such a deformed underlayment support layer would likely result in some of the paving elements 12 being so poorly supported that they would rock or wobble when applied with a normal load of a pedestrian or vehicle.

An advantage of the paving system 10 is that the need for excavating the native soil and replacing the native soil with up to 4 inches (10 cm) of a traditional compacted aggregate replacement base is eliminated. Also, the paving elements can be easily positioned and aligned by sliding on the surface of the underlayment support layer panels, assuming no bedding sand layer is being used. Further, the use of the underlayment support layer panels provides great load spreading over the native soil. It is to be understood that the underlayment support layer 16, 316 can be placed over traditional aggregate bases of crushed stone and the like. It is also to be understood that it may be advantageous to apply a layer of leveling sand on the soil or subgrade prior to applying the underlayment support layer 16.

Figure 10:
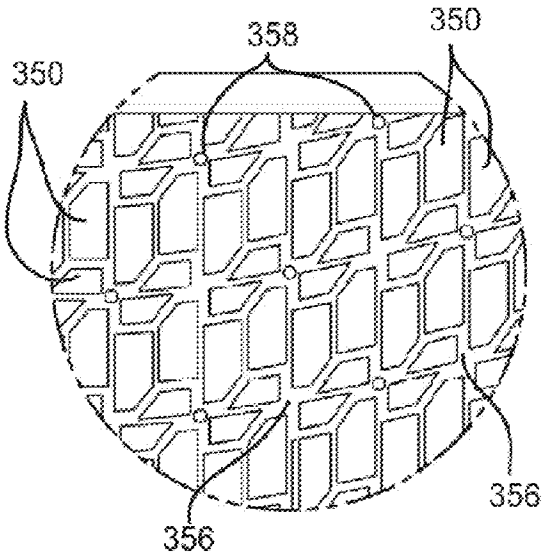
FIG. 10 is an enlarged view of a portion of the panel of FIG. 9.
Figure 9:
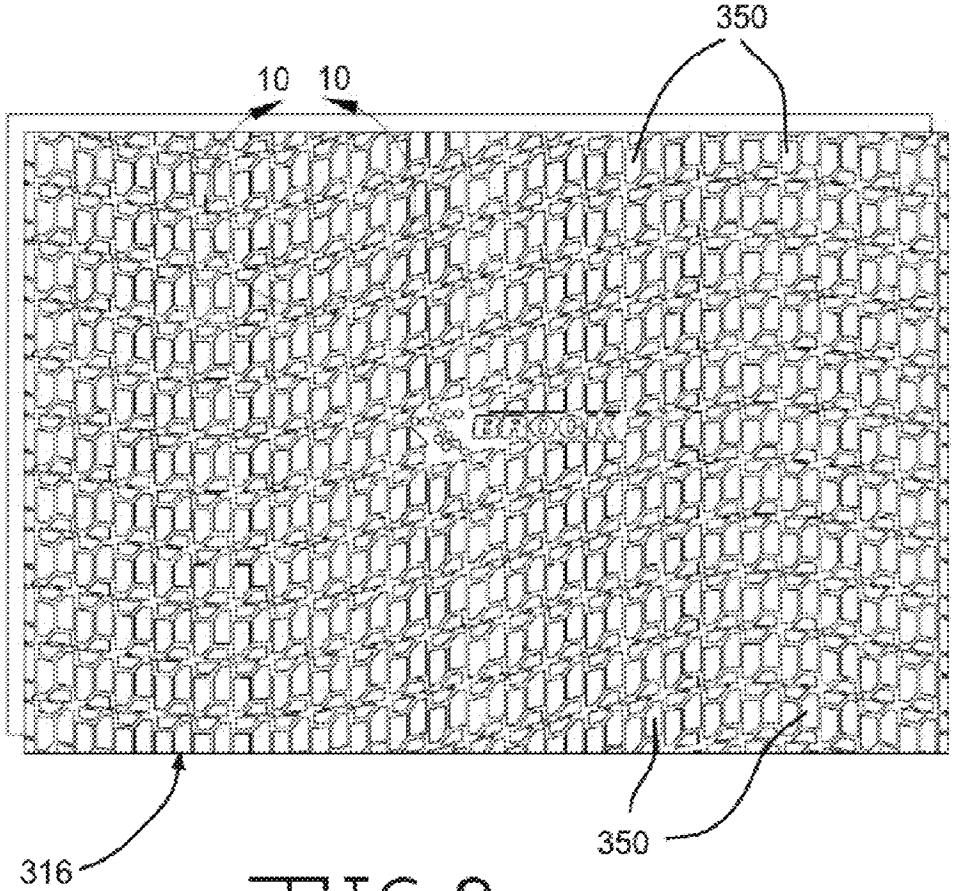
FIG. 9 is a plan view of an underlayment support layer panel suitable for providing support for paving elements in a paving system.

In some applications of paving systems there is a need for providing the system with the ability to drain rain water downward to the underlying water table rather than having the rain water flow away along the surface of the ground and be carried away by a storm drain system. As shown in FIGS. 10 and 12, the underlayment support layer 316 includes the drainage holes 358 and the upper and lower channels 356, 376. These elements of the underlayment support layer 316 allow water to flow downward through the paving system and into the sub-soil for eventual replenishment of the water aquifer. It is to be understood that the paving elements themselves can be porous to enhance the downward flow of rain water. Additionally, such a dispersed flow of water through the paving system 10 reduces soil erosion by allowing the water to pass through at a reduced velocity and force. Traditional installation techniques require excavation of up to 10 cm or more of native soil, and replacement of that soil with an equal amount of compacted aggregate. While the compacted aggregate provides a solid base of support for the paving support system, the compacted aggregate substantially prevents downward percolation or flow of rain water into the underlying soil. In this respect, the paving support system 10, which allows substantial downward flows of rain water, provides an advantage over conventional systems.

Figure 7A:
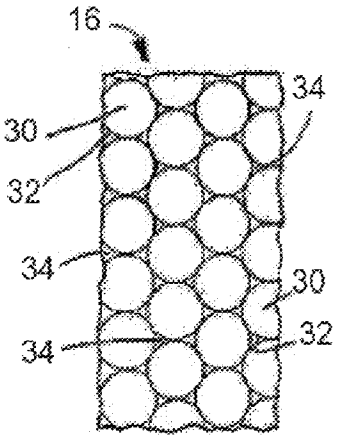
FIG. 7A is an enlarged elevational view of an underlayment layer having a bonded bead structure that includes interstitial spaces between the beads.
Figure 7C:
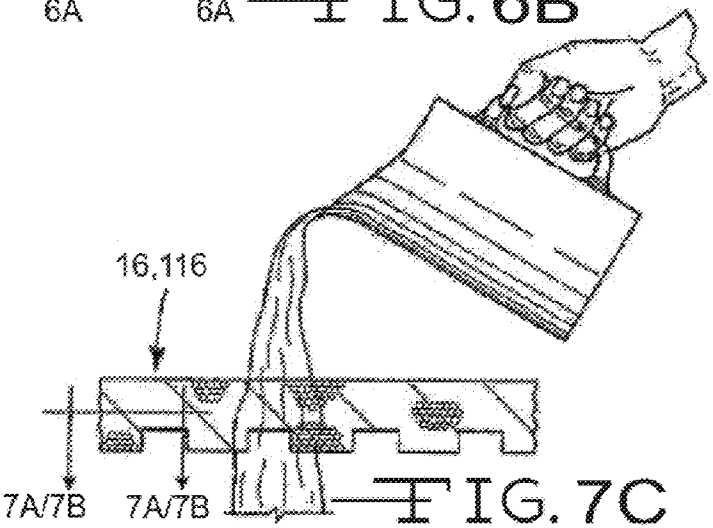
FIG. 7C is a schematic view illustrating the porosity of the underlayment support layer.

As described above, the underlayment support layer 16, 316 can be made of fused expanded polymer beads. In another embodiment, the underlayment support layer can be made by gluing or fusing expanded polymer beads in an open matrix that includes interstitial spaces. As shown in FIG. 7A, the polymer beads 30 may optionally be mixed with an adhesive 32 to bond the polymer beads together. The block of bonded beads allows interstitial voids 34 to form between adjacent beads 30. The bead and adhesive mixture is formed into a shape, such as a large rectangular mass (not shown), and may be compressed to form the beads into a unitary body or block. The compression of the block is controlled so that it does not eliminate the interstitial voids 34 formed between the adjacent beads 30. Though illustrated as spherical, the beads 30 may be any shape or a random amorphous shape if desired.

Figure 3:
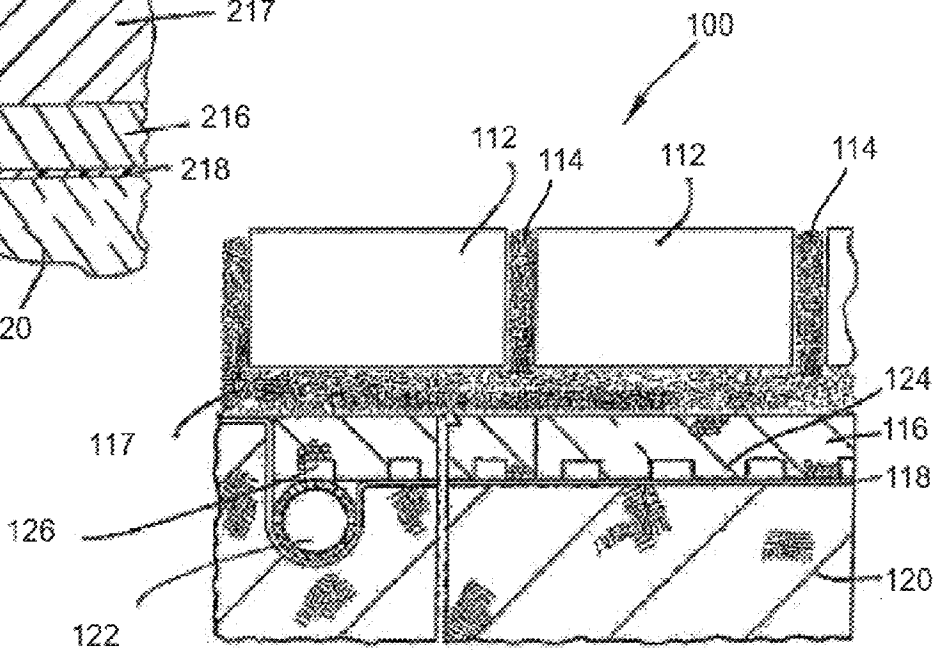
FIG. 3 is an elevational view of an alternative embodiment of the paving system of FIG. 1.

Referring now to FIG. 3, the support system 100 is illustrated having a fused bead underlayment 116 and a fluid drainage system 122. The support system 100 is an embodiment that may be used in both exterior and interior applications. As an interior application, the support system 100 may be a block floor in a manufacturing facility. Paving elements 112 may be rubber or wooden blocks, though other paving elements can be used. The paving elements 112 may be embedded into or placed on top of a bedding sand layer 117 that may be a chemically resistant or inert material, such as for example ground rubber, silica, or sand. Joint sand 114 can also be used. The paving elements 112 may be spaced apart or abutting adjacent paving elements if so desired. The support system 100 is configured to allow water and other fluids, such as for example machine oils or hazardous chemicals, to drain through to the underlayment layer 116. The drainage system 122 may be a series of perforated tiles or pipes and may also include pads 124 and drainage channels 126, formed on one or more surfaces of the underlayment 116.

Optionally a plurality of spaced apart drain holes 134 are formed through the underlayment layer to provide fluid communication between upper and lower surfaces of the underlayment 116, as illustrated in FIG. 7B. In the embodiment shown, a fluid impervious barrier layer 118 is placed between the underlayment 116 and a substrate 120, as shown in FIG. 3. The substrate 120 may be similar to the substrate 20, described above. The support system 100 of FIG. 3 allow fluids to pass through the bedding sand layer 117 and drain through the underlayment layer 116 to the barrier layer 118. The barrier layer 118 may be a water impervious layer, such as a rubber liner, vinyl liner, and the like. The fluids are then channeled along the barrier layer 118 to the drain system 122 for collection and processing. Such a support system 100 may allow factory machine oils, water, or other spilled contaminants to be washed or otherwise collected and separated in order to prevent contamination of subsurface ground water and other soil layers.

Figure 2:
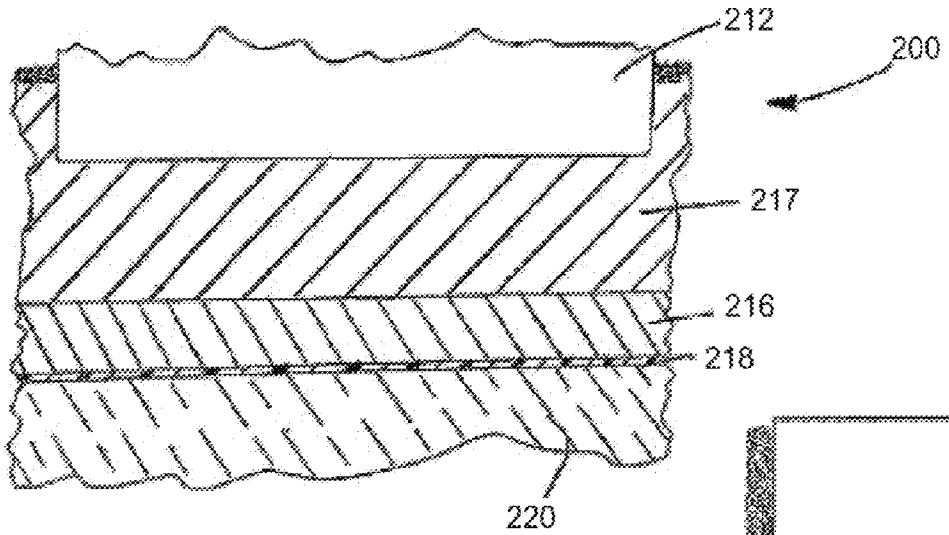
FIG. 2 is an enlarged elevational view, in cross section, of the paving system of FIG. 1.
Figure 6A:
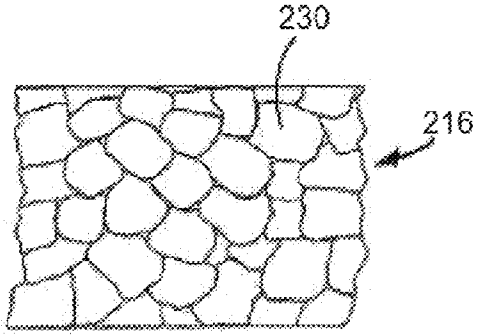
FIG. 6A is an enlarged elevational view of an underlayment support layer having a fused bead structure.
Figure 6B:
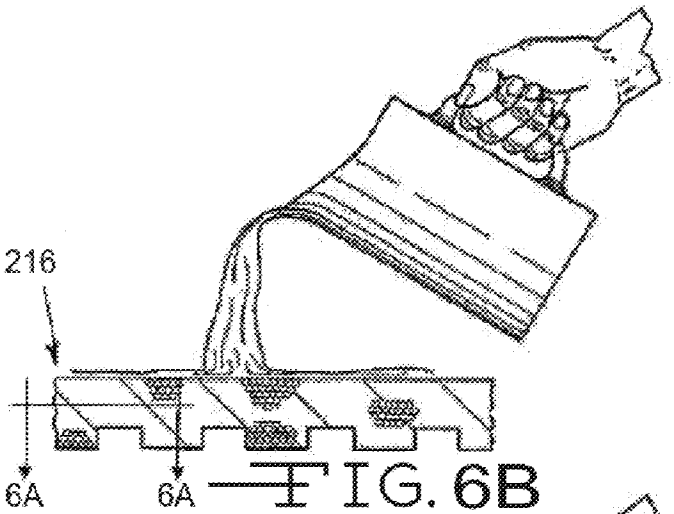
FIG. 6B is a schematic view illustrating the substantially water impervious nature of the underlayment support layer.

Referring now to FIG. 2, under certain conditions, a substrate layer 220 may provide a better foundation for a layer of paver elements if water is prevented from passing through its underlayment layer 216. For example, where the support of the substrate layer 220 may be affected by settling due to water flow, an underlayment 216 and/or a barrier layer 218 may be configured to be water impervious. Such an impervious support system 200 is shown in FIGS. 2, 6A, and 6B. The support system 200 includes the support surface 212, shown as paving elements which may be similar to paving elements 12 and 112, though such is not required. The paving elements 212 are illustrated as being partially embedded in a joint sand material 214, which may be similar to the joint sand materials 14 and 114, described above, though other materials, whether ground or naturally granular, may be used. A layer 217 of bedding sand is also shown. The underlayment layer 216 has no holes or voids that allow water drainage. Such a system 200 may be particularly advantageous when place over unstable soils, such as a clay soil.

Figure 8:
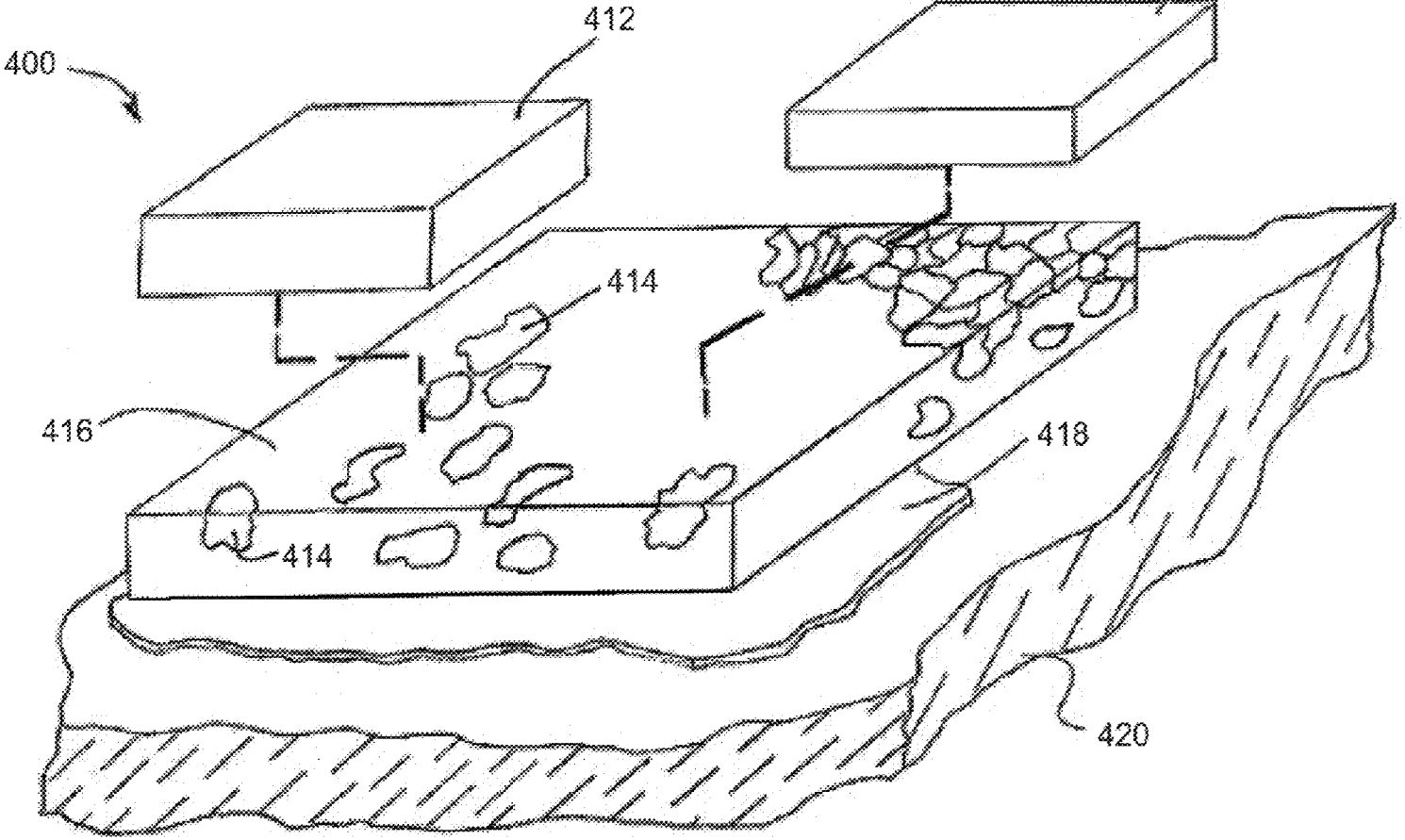
FIG. 8 is an exploded perspective view, in partial cross section, of an alternative embodiment of a paving system having an underlayment support layer.

Referring now to FIG. 8, there is illustrated another embodiment of a support system for paving and flooring elements, shown generally at 400. The flooring and paving support system 400 includes paving elements 412, which may be any form of discrete, individual paving elements, such as those previously described above. An underlayment layer 416 is provided in order to disperse concentrated loads from the paving elements onto a substrate layer 420 such as for example, native soil, compacted stone, or sand. The underlayment layer 416 may be an extruded pad having a homogenous cross section. Alternatively, the underlayment layer 416 may be formed from recycled materials, such as ground rubber from shoe soles, tires, and the like. The ground, recycled material may take the form of flakes 414 that are packed together. Such a ground underlayment 416 may be bonded together and exhibit a water impervious characteristic, similar to that depicted in FIG. 6B. Alternatively, the flakes 414, forming the ground underlayment 416, may include interstitial voids (not shown) that allow water to pass through the thickness of the underlayment 416. The interstitial voids may be formed between adjacent flakes 414 that are, themselves individually, water impervious. Alternatively, the flakes 414 themselves may be porous and may be bonded together such that the underlayment 416 allows water to pass through. The advantage of the underlayment layer 416 is that it is sufficiently rigid to disperse the concentrated loads that are applied from the paving elements onto a larger surface area of the native soil.

Figure 4B:
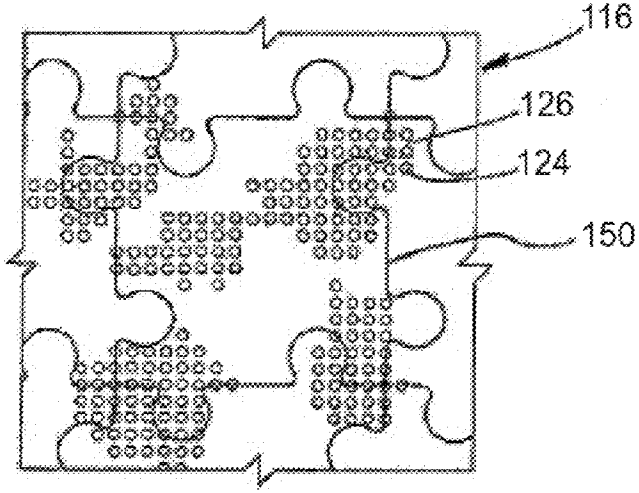
FIG. 4B is a plan view of an alternative embodiment an underlayment support layer having interlocking sections similar to FIG. 4A.
Figure 4A:
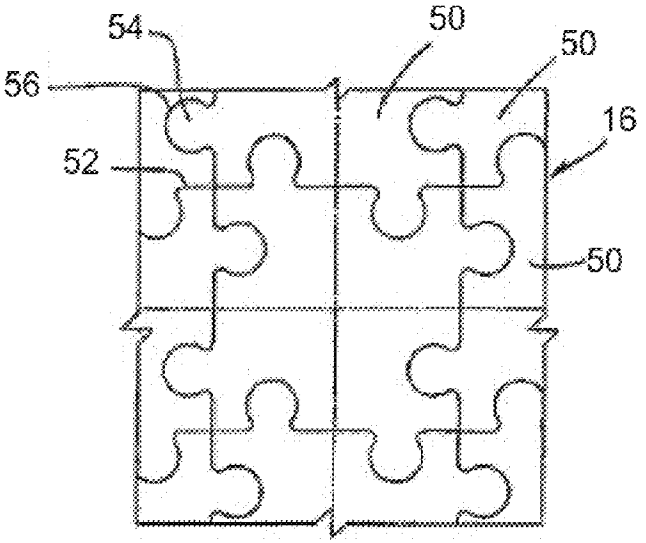
FIG. 4A is a plan view of an underlayment support layer having interlocking sections.

Referring now to FIG. 4A, the underlayment layer 16 may be formed into discrete panel sections 50 that may be assembled to cover the entire substrate layer, such as substrate 20. The panel sections 50 are separated along boundary lines 52. The panel sections 50 may be formed into puzzle-like pieces having locking tabs 54 that engage correspondingly shaped slots 56. The panel sections 50 are interlocking to prevent separation along the surface of the substrate 20 during installation. Referring now to FIG. 4B, the underlayment layer 116 may be similarly divided into panel sections 15 that include pads 124 and channels 126 formed onto the surface.

Figure 5:
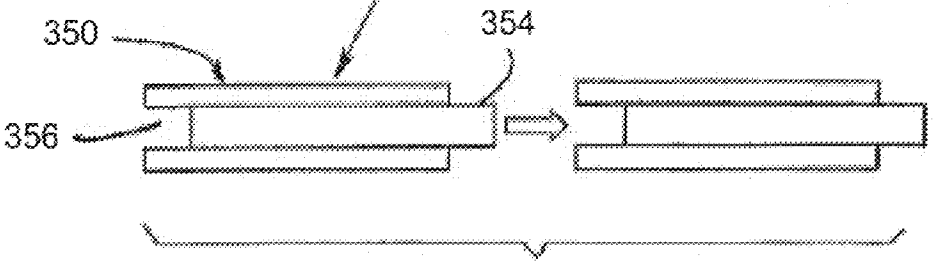
FIG. 5 is an elevational view of an embodiment of an underlayment support layer having a flanged interlocking structure.

FIG. 5 illustrates an embodiment of a panel section 350 having a tongue-and-groove configuration, A tongue 354 axially engages (in the direction of the arrow) a corresponding groove 356 to prevent lateral relative movement of mating panel sections. Alternatively, the underlayment 16, 116, and 216 may be a rolled material that is laid out onto the ground. The rolled material may have puzzle-like tabs and slots or may have tongue-and-groove edges if desired. Alternatively, any edge locking arrangement may be used between adjacent panels.

The support system 10 of FIG. 1 uses the underlayment layer 16 shown in FIGS. 7A and 7B. The underlayment layer 16 is formed from a plurality of polymer beads 30 that are bonded together to form a unitary body or block. Additionally, the underlayment layer 16 may also include reclaimed scrap bead material, termed "regrind", that may include sections of previously cured bead and adhesive mixture that is ground or otherwise broken into smaller pieces and introduced into the new bead and adhesive mixture. In one embodiment, the underlayment support layer is made of fully recyclable material, such as polypropylene material such that the reclaimed material can be re-melted, extruded into pellets which are then expanded into new beads for use in steam chest molding of any expanded polypropylene part including new underlayment parts 16.

Example III

One example of a paver system includes the following layers: compacted subgrade, geotextile material, bedding sand, underlayment support layer panel, and layer of paving elements. The geotextile material is optional, the bedding sand can be either compacted or uncompacted, and the layer of paving elements can optionally be treated with sand or a polymer sand material.

Example IV

In another example, the paver system includes the following layers: compacted subgrade, geotextile material, an optional leveling sand layer, underlayment support layer panel, bedding sand, layer of paving elements and joint sand. The geotextile material is optional, the bedding sand can be either compacted or uncompacted, and the joint sand can be with or without polymer treatment.

Example V

In yet another example, the paver system includes the following layers: subgrade, thin compacted stone sub-base, geotextile material, bedding sand, underlayment support layer panel, and layer of paving elements. The geotextile material is optional, and the layer of paving elements can optionally be treated with sand or a polymer sand material.

Example VI

In an additional example, the paver system includes the following layers: subgrade, thin compacted stone sub-base, geotextile material, underlayment support layer panel, bedding sand, and layer of paving elements. The geotextile material is optional, and the layer of paving elements can optionally be treated with sand or a polymer sand material.

It is to be understood that in some applications of the paving support system 10, a perimeter restraint or edging system, not shown, can be employed.

Figure 13:
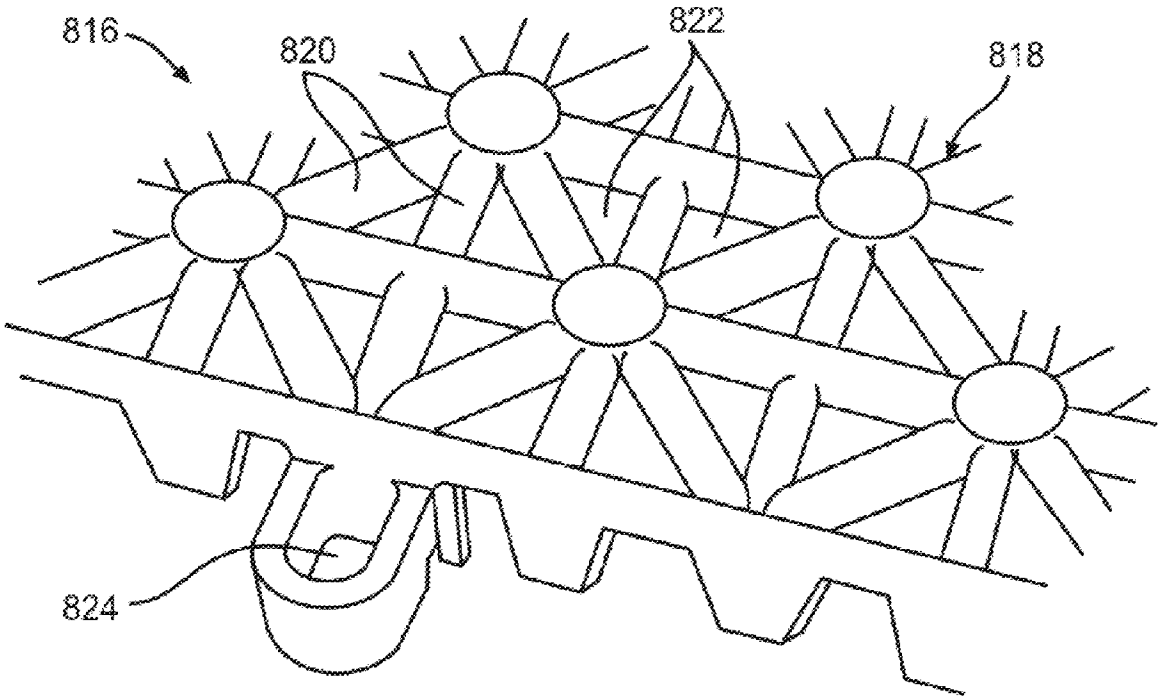
FIG. 13 is a perspective view of an alternate form of the underlayment support layer.

FIG. 13 is a perspective view of an alternate form of the underlayment support layer. The underlayment support layer does not necessarily have to be a foamed layer, and can instead be a different polymer layer. For example, as shown in FIG. 13, a molded plastic support porous grid layer 816 can be used. The molded plastic porous grid includes a lattice network 818 formed by elements 820. The network 818 includes openings 822 for the flow of fluid. Attachment connections 824 can optionally be provided to connect multiple panels. It is to be understood that the polymeric material of the underlayment support layer can take many different forms.

Figure 14:
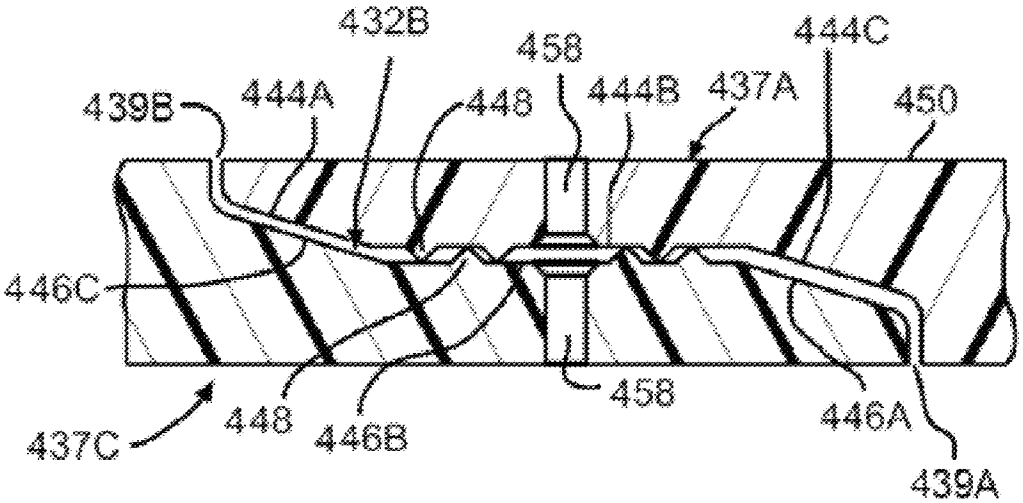
FIG. 14 is an enlarged cross sectional view, in elevation, of an interlocking edge of an underlayment panel and an adjacent mated underlayment panel.
Figure 17:
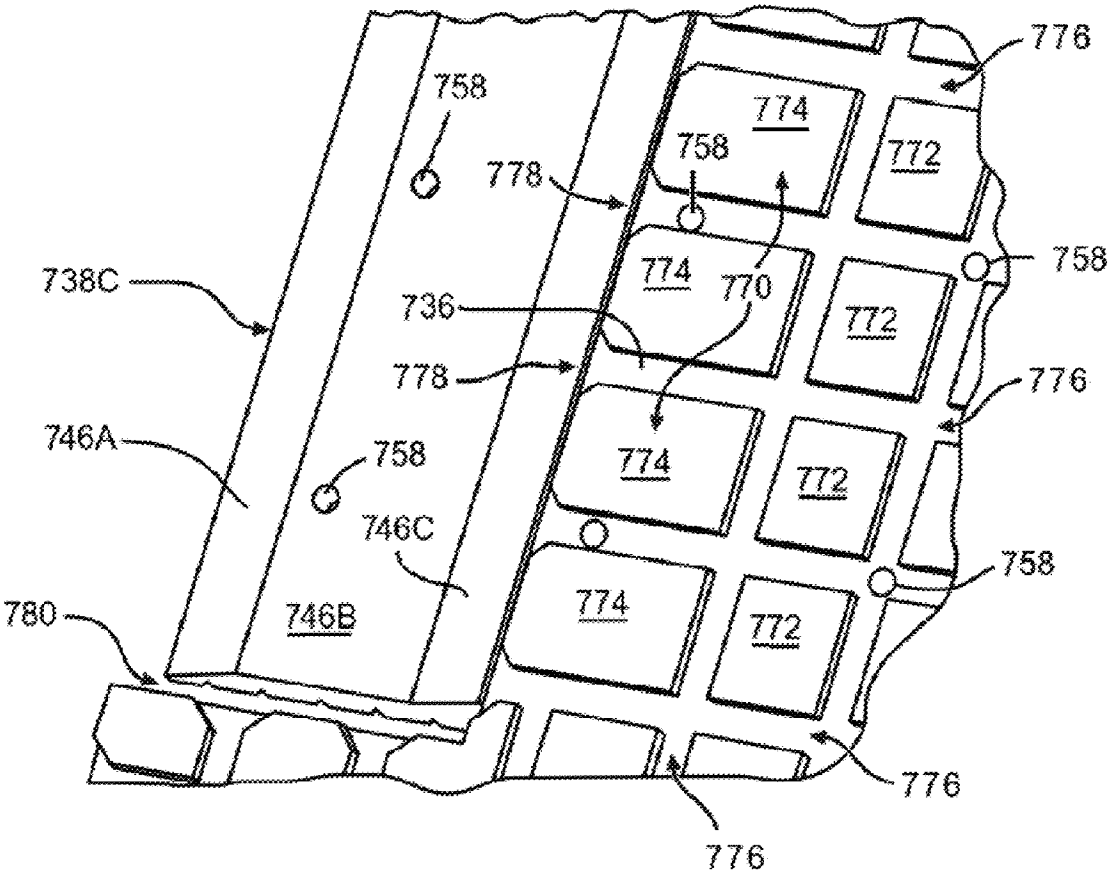
FIG. 17 is an enlarged view of an embodiment of an interlocking edge and bottom projections of an underlayment panel.

As can be seen in FIG. 14, which illustrates two panels in an abutting relationship, the abutment of the edges of the adjacent panels defines a bottom water flow connector slot 439A at the intersection of the abutting panels. The bottom water flow connector slot 439A is in fluid communication with bottom side water drainage channels 776, shown in FIG. 17, that may be provided on each of the two abutting panels, thereby providing a path for the flow of water from one panel to an abutting panel. In one embodiment, the bottom water flow connector slot 439A is in fluid communication with more than one bottom side water drainage channel 776 of each of the two abutting panels. In one embodiment, the water flow connector slot 439A is substantially parallel to the edges of the panels. In one embodiment, the bottom side water drainage channels 776 of each of the two abutting panels are oriented to intersect the edges of the panel at an angle substantially transverse to the edges of the panel, and the water flow connector slot 439A is substantially parallel to the edges of the panels. In one embodiment, there is a top water flow connector slot 439B in fluid communication with top side water drainage channels, that may be similar to the bottom side drainage channels 776, of adjacent panels. As can be seen in FIG. 14, the top and bottom water flow connector slots 439A and 439B cooperate to form a channel that fluidly connects the top and bottom surfaces of the panel.

Figure 15:
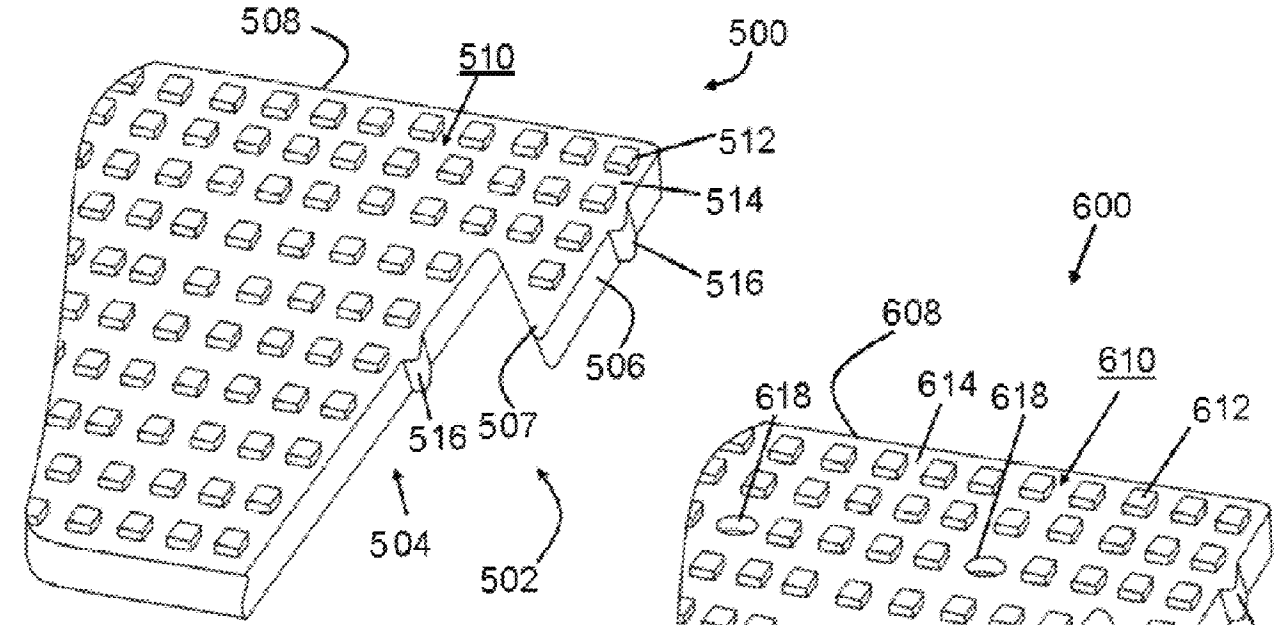
FIG. 15 is a sectioned, perspective view of another embodiment of an underlayment panel.

Referring now to FIG. 15, an embodiment of an underlayment panel, shown generally at 500, includes an interlocking edge 502. The interlocking edge 502 of the panel 500 includes a dovetail recess 504 that is defined by dovetail projections 506 and hook portions 507 spaced on either side and an abutting panel edge 508. An upper surface or top side 510 of the panel 500 includes a plurality of spaced-apart projections 512 that define drainage channels 514 to facilitate the flow of water across the panel 500. The bottom side (not shown) of panel 500 may be similarly configured, if desired. Alternatively, the bottom side may include only drainage channels (not shown). Though shown as square projections having rounded corners and straight sides, the projections 512 may be any suitable geometric shape desired. The panel 500 further includes projections 516 disposed along the interlocking edge 502 that space abutting panels apart. The projections 516 may provided in any suitable number and position along the perimeter of the panel 500, as desired. When the panel 500 is connected to similar panels to form an underlayment layer and the assembled panels are spaced apart, a drainage space or passage is formed to permit water runoff to exit the topside 510 of the panel 500 and migrate to a subsurface support layer (not shown). The projections 516 may also act as crush ribs or discrete deflection points that permit relative movement of abutting panels in response to thermal conditions or load-applied deflections.

Figure 16:
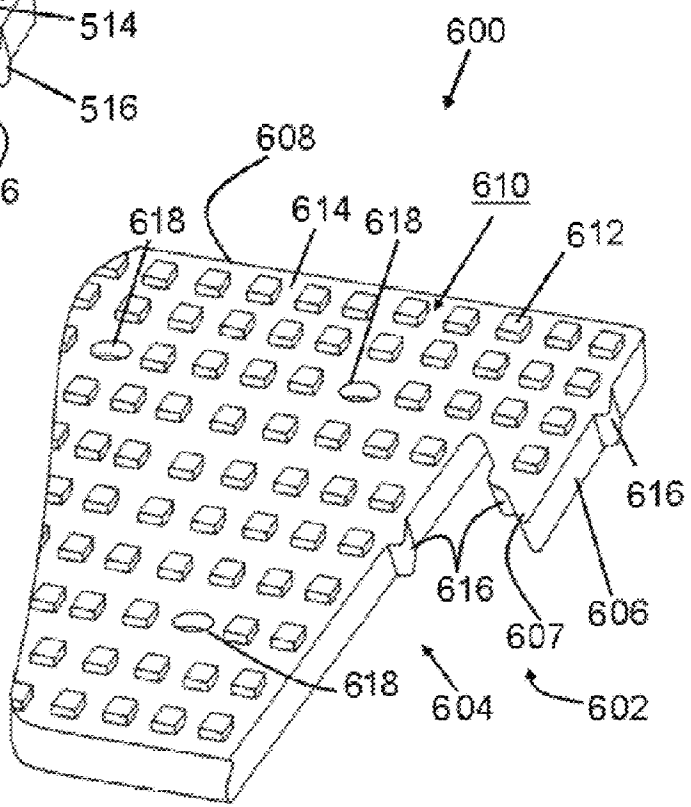
FIG. 16 is a sectioned, perspective view of yet another embodiment of an underlayment panel, similar to the underlayment panel of FIG. 15.

Referring now to FIG. 16, there is illustrated another embodiment of an underlayment panel, shown generally at 600. The underlayment panel 600 is similar to panel 500, described above, and includes similar features, such as an interlocking edge 602 having a dovetail recess 604 defined by dovetail projections 606 (only one is shown) and hook portions 607. The panel 600 further includes abutting edges 608 (one shown). An upper or top surface 610 of panel 600 includes projections 612 that provide support for paving elements (not shown). The spaced-apart projections 612 define top side drainage channels 614 that provide for water flow. The top side drainage channels 614 are in fluid communication with a plurality of drain holes 618 that are sufficiently sized and spaced across the top surface 610 to facilitate water drainage to the substrate layer below. The drain holes 618 may be in fluid communication with the bottom side (not shown) that includes any of the bottom side embodiments described herein. The interlocking edge 602 of the panel 600 includes at least one projection 616, and preferably a plurality of projections 616. The projections 616 may be positioned on the dovetail projection, the dovetail recess 604, the hook portion 607, and the abutting edge 608 (not shown) if desired.

Referring again to FIG. 17, the bottom side 736 includes a lower support surface 770 defined by a plurality of downwardly extending projections 772 and a plurality downwardly extending edge projections 774. The plurality of projections 772 and edge projections 774 of the panel 730 cooperate to define drainage channels 776 to facilitate water flow beneath the panel. The edge projections 774 cooperate to form a funnel edge 778 at the end of the drainage channel 776. These funnel edges 778 may be aligned with similar funnel edges 778 on adjacent panels and provide a greater degree of installation tolerance between mating panel edges to create a continuous channel 776 for water drainage. The bottom projections 772 and edge projections 774 may be, for example, larger in surface area than top projections, such as the top side projections 512 shown in FIG. 15, and shallower, or protrude to a lesser extent, though other relationships may be used.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A paving system for paving comprising:

a top layer of a plurality of paving elements; and an underlayment support layer in the form of panels positioned underneath the top layer, the panels being made of a core with a top side and a bottom side, the core being made from expanded polymeric bead material that is substantially impervious to fluid flow, but the panels having spaced apart drainage holes that interconnect the panel top side with the panel bottom side such that the overall underlayment layer is porous to the flow of fluids, the panels having a plurality of projections extending across the bottom side of the panel, the projections forming bottom channels suitable for water drainage flow.

2. The paving system of claim 1 in which the panels have a plurality of projections extending across the top side of the panel, the projections forming top channels suitable for water drainage flow.

3. The paving system of claim 2 in which the size and quantity of at least one of the top side channels and bottom side channels provide dispersion of fluid flow through the underlayment layer sufficient to reduce soil erosion beneath the paving system.

4. The paving system of claim 1 in which the panels are formed by placing the expanded foam beads into a mold under pressure and subjecting the beads to a steam application sufficient to soften and melt together the beads at interfaces between the beads.

5. The paving system of claim 2 in which the panels are reversible so that the paving elements can be placed above either side of the panels.

6. The paving system of claim 2 in which the density of the panels is within the range of from about 50 to about 60 g/l.

7. The paving system of claim 2 in which the drainage holes intersect the top drainage channels and the bottom drainage channels.

8. The paving system of claim 2 in which the top side water drainage channels are spaced in a different arrangement relative to the arrangement of the bottom side water drainage channels so that there is substantial non-alignment of the bottom side water drainage channels relative to the top side water drainage channels, with some overlapping between the top side water drainage channels and the bottom side water drainage channels, and wherein the drainage holes intersect the top drainage channels and the bottom drainage channels.

9. The paving system of claim 1 in which the panels have edges, and in which the bottom side projections adjacent the edges are arranged so that the bottom drainage channels have a wider spacing at the edges than at locations spaced away from the edges.

10. The paving system of claim 2 in which at least one of the top projections and the bottom projections has a friction enhancing surface configured as one of bumps, raised nibs, ribs, and dots.

11. The paving system of claim 10 in which the friction enhancing surface is a plurality of raised dots.

12. The paving system of claim 2 in which at least one of the top drainage channels and the bottom drainage channels has a friction enhancing surface configured as one of bumps, raised nibs, ribs, and dots.

13. The paving system of claim 12 in which the friction enhancing surface is a plurality of raised dots.

14. A paving system for paving comprising:

a top layer of a plurality of paving elements; and an underlayment support layer in the form of panels positioned underneath the top layer, the panels being made of a core with a top side and a bottom side, the core being made from expanded polyolefin bead material molded by heat expansion in a mold, the panels having a plurality of projections extending across the bottom side of the panel, the bottom projections forming bottom drainage channels suitable for water drainage flow, the panels having a plurality of projections extending across the top side of the panel, the top projections forming top drainage channels suitable for water drainage flow, the panels having spaced apart drainage holes that interconnect the panel top side with the panel bottom side such that the overall underlayment layer is porous to the flow of fluids, with the drainage holes intersecting the top drainage channels and the bottom drainage channels.

15. The paving system of claim 14 in which at least one of the top projections and the bottom projections has a friction enhancing surface configured as one of bumps, raised nibs, ribs, and dots.

16. The paving system of claim 15 in which the friction enhancing surface is a plurality of raised dots.

17. The paving system of claim 14 in which the panels are reversible so that the paving elements can be placed above either side of the panels.

18. The paving system of claim 14 in which the panels are formed by placing the expanded foam beads into a mold under pressure and subjecting the beads to a steam application sufficient to soften and melt together the beads at interfaces between the beads.

19. The paving system of claim 14 in which the top side water drainage channels are spaced in a different arrangement relative to the arrangement of the bottom side water drainage channels so that there is substantial non-alignment of the bottom side water drainage channels relative to the top side water drainage channels.

20. A paving system for paving comprising:

a top layer of a plurality of paving elements; and an underlayment support layer in the form of panels positioned underneath the top layer, the panels being made of a core with a top side and a bottom side, the core being made from expanded polyolefin bead material molded by heat expansion in a mold, the panels having a plurality of projections extending across the bottom side of the panel, the bottom projections forming bottom drainage channels suitable for water drainage flow, the panels having spaced apart drainage holes that interconnect the panel top side with the panel bottom side such that the overall underlayment layer is porous to the flow of fluids, the panels having edges, wherein the bottom side projections adjacent the edges are arranged so that the bottom drainage channels have a wider spacing at the edges than at locations spaced away from the edges.

21. The paving system of claim 20 in which the panel has a plurality of projections extending across the top side of the panel, the projections forming top channels suitable for water drainage flow.

22. The paving system of claim 20 in which at least one of the top projections and the bottom projections has a friction enhancing surface configured as one of bumps, raised nibs, ribs, and dots.

23. The paving system of claim 22 in which the friction enhancing surface is a plurality of raised dots.

24. The paving system claim 21 in which the panels are formed by placing the expanded foam beads into a mold under pressure and subjecting the beads to a steam application sufficient to soften and melt together the beads at interfaces between the beads.

25. An underlayment support panel for a paving system, the underlayment support panel being made of a core with a top side and a bottom side, the core being made from expanded polymeric bead material that is substantially impervious to fluid flow, but the panel having spaced apart drainage holes that interconnect the panel top side with the panel bottom side such that the overall underlayment layer is porous to the flow of fluids, the panel having a plurality of projections extending across the bottom side of the panel, the projections forming bottom channels suitable for water drainage flow.

26. The underlayment support panel of claim 21 in which the panel has a plurality of projections extending across the top side of the panel, the projections forming top channels suitable for water drainage flow.

27. The underlayment support panel of claim 25 in which with the top side water drainage channels are spaced in a different arrangement relative to the arrangement of the bottom side water drainage channels so that there is substantial non-alignment of the bottom side water drainage channels relative to the top side water drainage channels.

28. The underlayment support panel of claim 25 in which at least one of the top projections and the bottom projections has a friction enhancing surface configured as one of bumps, raised nibs, ribs, and dots.

29. The underlayment support panel of claim 28 in which the friction enhancing surface is a plurality of raised dots.

30. The underlayment support panel of claim 25 in which the panels are reversible so that the paving elements can be placed above either side of the panels.

* * * * *